US011499701B1

(12) United States Patent
Meyers

(10) Patent No.: US 11,499,701 B1
(45) Date of Patent: Nov. 15, 2022

(54) CEILING FAN BLADE COVER

(71) Applicant: Erin Meyers, Branchville, NJ (US)

(72) Inventor: Erin Meyers, Branchville, NJ (US)

( * ) Notice: Subject to any disclaimer, the term of this patent is extended or adjusted under 35 U.S.C. 154(b) by 0 days.

(21) Appl. No.: 17/729,767

(22) Filed: Apr. 26, 2022

Related U.S. Application Data

(60) Provisional application No. 63/179,617, filed on Apr. 26, 2021.

(51) Int. Cl.

| | |
|---|---|
| ***F21V 19/00*** | (2006.01) |
| ***F21V 23/00*** | (2015.01) |
| *F21W 121/00* | (2006.01) |
| *F21Y 115/10* | (2016.01) |
| *F21Y 113/10* | (2016.01) |

(52) U.S. Cl.
CPC ..... *F21V 19/003* (2013.01); *F21V 23/003* (2013.01); *F21W 2121/00* (2013.01); *F21Y 2113/10* (2016.08); *F21Y 2115/10* (2016.08)

(58) Field of Classification Search
CPC ..... F21V 23/003; F21V 19/003
See application file for complete search history.

(56) References Cited

U.S. PATENT DOCUMENTS

| | | | | |
|---|---|---|---|---|
| 5,591,005 | A | 1/1997 | McCready | |
| 5,591,006 | A | 1/1997 | DeMeo et al. | |
| 6,019,577 | A * | 2/2000 | Dye | F04D 25/088 362/147 |
| 6,199,813 | B1 * | 3/2001 | Oliva | F04D 25/088 248/342 |
| 6,309,083 | B1 * | 10/2001 | Lathrop | F24F 13/078 362/350 |
| 6,619,920 | B1 | 9/2003 | Cannon | |
| 10,865,981 | B1 * | 12/2020 | Petrollini | F04D 29/005 |
| 2006/0120064 | A1 | 6/2006 | McElhannon | |
| 2007/0009357 | A1 | 1/2007 | Solak | |
| 2020/0408223 | A1 * | 12/2020 | Kuramochi | F21V 19/0015 |

* cited by examiner

*Primary Examiner* — Bryon T Gyllstrom
*Assistant Examiner* — Christopher E Dunay
(74) *Attorney, Agent, or Firm* — Boudwin Intellectual Property; Daniel Boudwin

(57) ABSTRACT

A ceiling fan blade cover is provided. The device includes a flexible body and a lighting element. The flexible body includes a closed end and an open end. The open end defines an opening. The flexible body is designed to cover an individual ceiling fan blade. An attaching member is disposed on the flexible body. A fastener encircles the opening. The fastener secures the ceiling fan blade cover to the ceiling fan blade. In one embodiment, the fastener is an elastic band. In another embodiment, the fastener is an adjustable string with a slidable toggle. The lighting element includes a securing member that connects to the attaching member. The securing member secures the lighting element to the flexible body. The lighting element includes a transceiver which is operably connected to a controller. The controller may alter the color, pulsation, and intensity of illumination from the lighting element.

10 Claims, 2 Drawing Sheets

CEILING FAN BLADE COVER

CROSS REFERENCE TO RELATED APPLICATIONS

This application claims the benefit of U.S. Provisional Application No. 63/179,617 filed on Apr. 26, 2021. The above identified patent application is herein incorporated by reference in its entirety to provide continuity of disclosure.

BACKGROUND OF THE INVENTION

The present invention relates to a ceiling fan blade cover. More specifically, the present invention provides a ceiling fan blade cover comprising one or more lighting elements attached thereto.

Air in a closed room may become stale. Typically, the air within the room will become stale when fresh air is unable to circulate therein. Stale air contains a buildup of pollutants. These pollutants may include an odor that is unpleasant for the individuals in the room and may affect the humidity within the room. A common way to prevent the air within the room from becoming stale is by opening a door or window to allow fresh air to enter the room and to circulate therein. However, in certain climates during certain times of the year, the outdoor temperature may be too cold for an individual to open a window. In such situations, individuals will typically use a ceiling fan to circulate the air within the room. Standard ceiling fans include a plurality of fan blades that rotate around a centralized motor. When in operation, the rotation of the plurality of fan blades will circulate the air within the room to prevent the buildup of pollutants. The standard celling fans provide individuals with an effective way to prevent stale air within a closed room. In some cases, the standard ceiling fans may lack an aesthetically appealing appearance.

The standard ceiling fans are often neutral colors. The appearance of the standard ceiling fans is maybe plain, boring, and uninspiring. For children and teenagers who have a ceiling fan in their bedroom, the ascetics of the standard ceiling fans often look out of place in their room. These children might want to have the ability to express their interest and personality in all aspects of their room—including their ceiling fan. Moreover, for individuals that want certain rooms within their home that have a decorative theme or aura, having all aspects of the room be consistent with the desired appearance is important. Specifically, altering the appearance of the ceiling fans will provide the individual with a more aesthetically appealing appearance that will not know permit the ceiling fan to remain functional, but also allows the individual to express themselves.

Currently available methods that alter the appearance of a standard ceiling fan may be difficult to remove. A user may apply paint, paper with an adhesive, or stickers upon the blades of a ceiling fan to provide some customization. However, these methods to alter the appearance of the ceiling fan blades usually do not have a way to be removed with ease. Although many individuals may want just a temporary appearance change that can be easily removed therefrom, the commonly used methods of alteration often will result in the alteration becoming a permanent to the blades of the ceiling fan. For individuals who enjoy changing the decorative theme of a room to reflect the season or an upcoming holiday, they would prefer a method to alter the appearance of the standard ceiling fan which is easy to remove.

In addition to altering the appearance of the ceiling fan blades, some individuals enjoy having active lighting elements to illuminate the room or to create a desired ambience. Moreover, for individuals that enjoy listening to music or performing meditation, having an active light that provides a calming ambience will enhance the individual's experience. When the ceiling fan is activated, the ceiling fan blades are rotating. With a lighting element placed thereon, the ceiling fan blades can assist in creating a desired ambience and have a light display. Specifically, the lights reflecting off the ceiling can help provide an illumination of the entire room that will allow the individual therein to achieve their preferred state of mind.

Therefore, there is a defined need amongst the known prior art references for a ceiling fan blade cover which includes one or more lighting element that can achieve a desired expression and ambience.

SUMMARY OF THE INVENTION

In view of the foregoing disadvantages inherent in the known types of ceiling fan blade covers now present in the known art, the present invention provides a flexible body that includes a lighting element.

It is therefore an object of the present invention to provide a covering for generic ceiling fan blades to illuminate and display an individual's artistic expression. The flexible body of the present invention will conform to the shape of the ceiling fan blades. A graphical design is disposed upon the flexible body. While the flexible body is secured to the ceiling fan blade, the graphical design will be displayed and cover the typical dull color of generic ceiling fans. Additionally, the graphical design provides a chance to display an individual's personal preference to express their personality. Moreover, a lighting element is disposed on the flexible body. The lighting element will provide illumination and provide a desired ambience. If the lighting element is positioned on the top of the ceiling fan blade, the lighting element will reflect on the above ceiling to provide enhance illumination. If the lighting element is positioned on the bottom of the ceiling fan blade, the lighting element will shine down upon the room below the ceiling fan to provide illumination.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
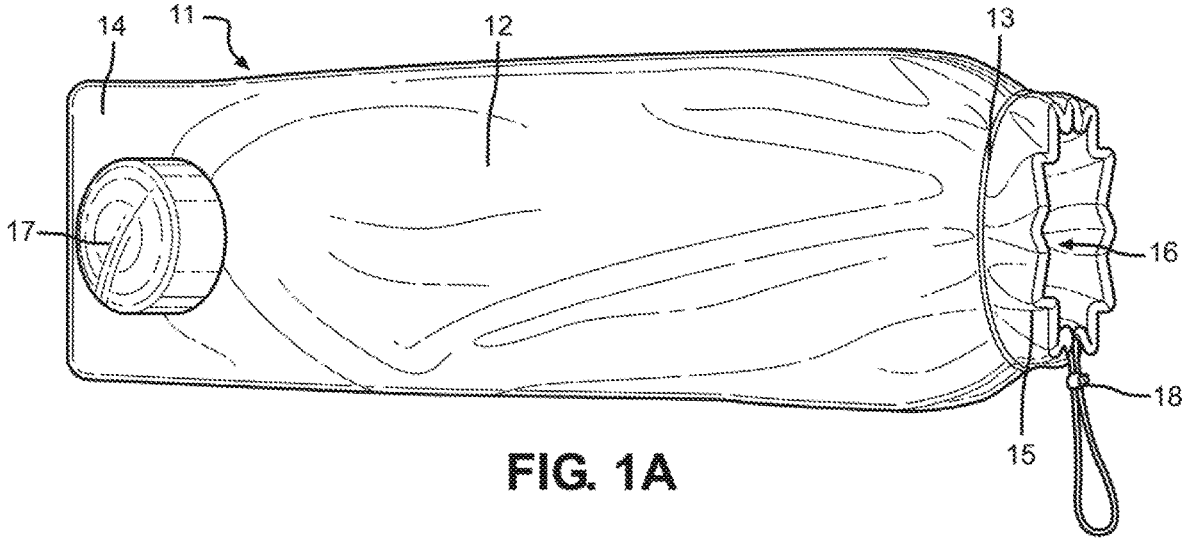
FIG. 1A shows a perspective view of an embodiment of the ceiling fan blade cover.

Reference is made herein to the attached drawings. Like reference numerals are used throughout the drawings to depict like or similar elements of the ceiling fan blade cover. The figures are intended for representative purposes only and should not be limiting in any respect.

FIG. 1A shows a perspective view of an embodiment of a ceiling fan blade cover. The ceiling fan blade cover 11 comprises a flexible body 12 and a lighting element 17. The flexible body 12 includes a closed end 14 and an open end 13. The closed end 14 and the open end 13 are on opposing ends of the flexible body 12. The flexible body 12 is configured to fit around a ceiling fan blade. The open end 13 defines an opening 16. The opening 16 provides access to an internal volume of the flexible body 12. The lighting element 17 is disposed on the flexible body 12. The lighting element 17 is oriented towards the closed end 14 of the flexible body 12. The orientation of the lighting element 17 towards the closed end 14 prevents a ceiling fan blade from experiencing an unbalanced weight distribution while in use. A ceiling fan blade that experiences such an unbalanced weight distribution may be rendered ineffective. The lighting element 17 provides illumination. In one embodiment, the lighting element 17 is an LED light. In some embodiments, the lighting element 17 comprises a plurality of colored lights.

A fastener 15 encircles the opening 16 of the open end 13 of the flexible body 12. The fastener 15 secures the ceiling fan blade cover 11 to a ceiling fan blade. In one embodiment, the fastener 15 is an elastic band. In said embodiment, the elastic band will conform to the shape of the ceiling fan blade for a secured attachment of the ceiling fan blade cover 11. In the shown embodiment, the fastener 15 is an adjustable string. The adjustable string encircles the opening 16. A slidable toggle 18 is attached to the adjustable string.

Figure 1B:
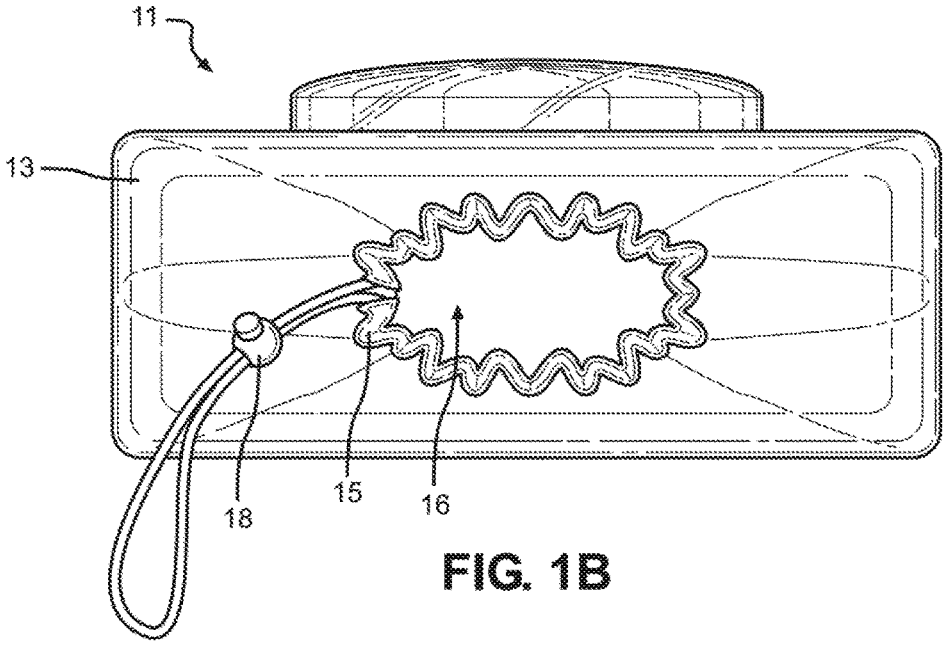
FIG. 1B shows a front view of an embodiment of the ceiling fan blade cover.

FIG. 1B shows a front view of an alternative embodiment of a ceiling fan blade cover. The ceiling fan blade cover 11 includes the opening 16 on the open end 13 of the flexible body. The opening 16 allows for a ceiling fan blade to enter the flexible body therein. In the shown embodiment, the fastener 15 is an adjustable string which encircles the opening 16. The adjustable string is threaded through a slidable toggle 18. The user may adjust the slidable toggle 18 along the adjustable string to adjust the size of the opening 16. The slidable toggle 18 will slide along the adjustable string, away from the opening 16, for the opening 16 to be at its widest. The slidable toggle 18 will slide towards the opening 16, for the opening 16 to closed. The slidable toggle 18 includes a push button that secures the position of the slidable toggle 18 along the adjustable string. The opening 16 will not open beyond the threshold of the slidable toggle 18.

Figure 2:
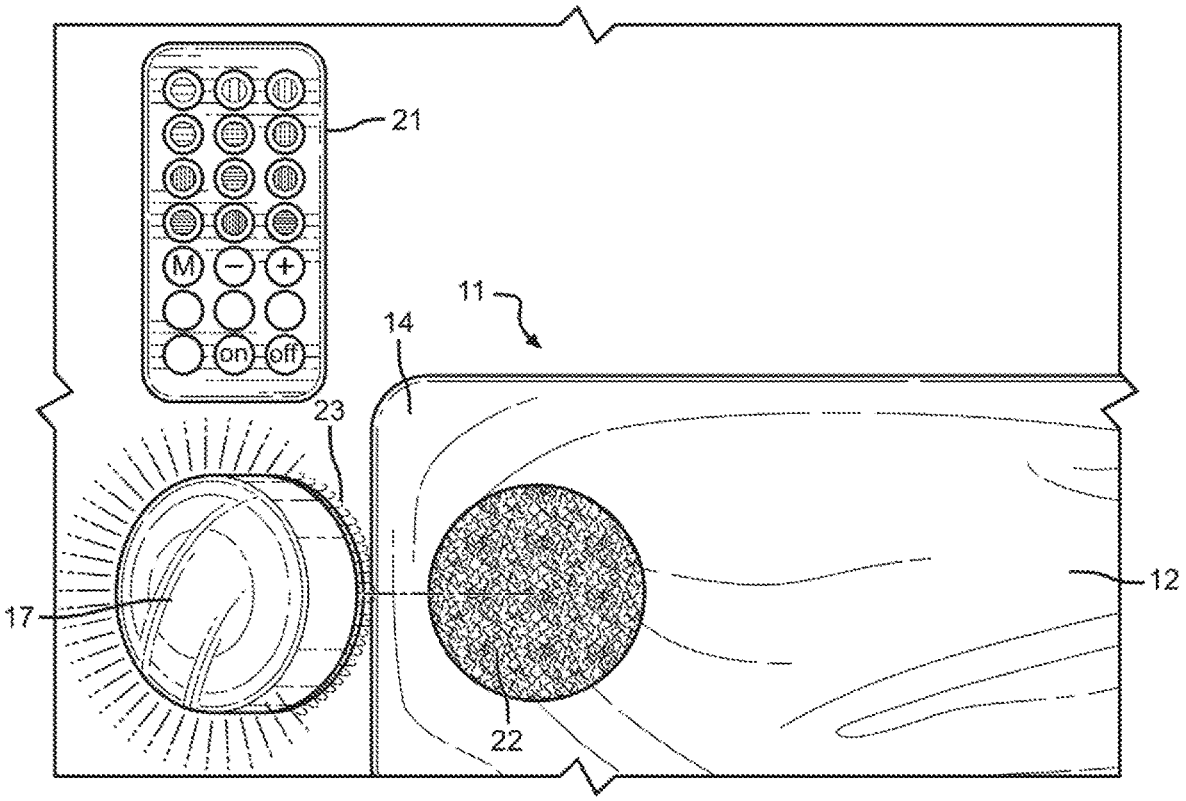
FIG. 2 shows a close-up view of an embodiment of the ceiling fan blade cover.

FIG. 2 shows a close-up view of an embodiment of a ceiling fan blade cover. The ceiling fan blade cover 11 includes a lighting element 17. The lighting element 17 further comprises an internal transceiver. The internal transceiver is operably connected to a controller 21. The controller 21 includes a transmitter that may provide commands to the internal transceiver. The controller 21 includes a plurality of actuators. In the shown embodiment, the plurality of actuators are push buttons. A first actuator of the plurality of actuators activates the lighting element 17. A second actuator of the plurality of actuators deactivates the lighting element 17. A third actuator of the plurality of actuators alters the illuminated color of the lighting element 17. A fourth actuator of the plurality of actuators alters the intensity of the lighting element 17. A fifth actuator of the plurality of actuators alters the pulsation of the lighting element 17.

An attaching member 22 is disposed on the flexible body 12. The attaching member 22 is oriented towards the closed end 14 of the flexible body 12. In the shown embodiment, the attaching member 22 is a hook and loop fastener. A securing member 23 is disposed on the lighting element 17. The securing member 23 engages with the attaching member 22 to secure the lighting element 17 to the flexible body 12. A user may selectively detach the lighting element 17 from the flexible body by detaching the securing member 23 from the attaching member 22.

Figure 3:
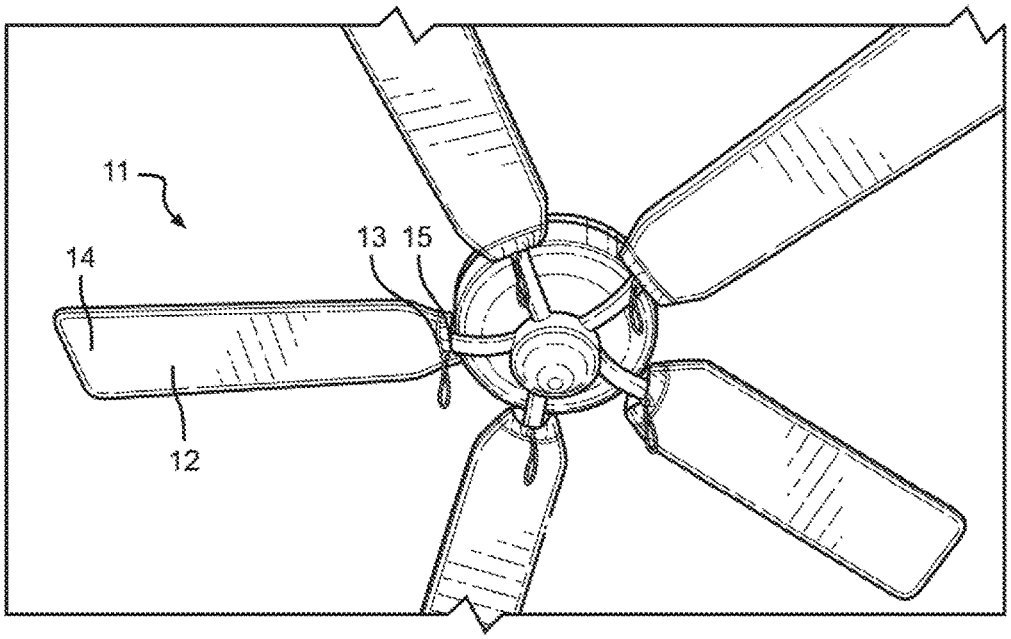
FIG. 3 shows a perspective view of an embodiment of the ceiling fan blade cover in use.

FIG. 3 shows a perspective view of an embodiment of the ceiling fan blade cover in use. The ceiling fan blade cover 11 includes the opening on the open end 13 of the flexible body 12. The opening allows for a ceiling fan blade to enter the flexible body 12 therein. The fastener 15 creates a seal around the ceiling fan blade to prevent the ceiling fan blade cover 11 from detaching from the ceiling fan blade when a corresponding ceiling fan is in use. Due to the centripetal force that is felt upon the ceiling fan blade while a corresponding ceiling fan is rotating about a central axis, the ceiling fan blade cover 11 will experience a force. The fastener 15 will prevent said force from detaching the ceiling fan blade cover 11 from the ceiling fan blade. In the embodiment whereby the fastener 15 comprises an elastic band, the elastic band is biased to close the opening of the ceiling fan blade covering. Typically, ceiling fan blades have a wider width the further away from the center of the ceiling fan. The elastic band will expand to fit around wider portions of a ceiling fan blade and retract to the narrower portions of the ceiling fan blade. The closed end 14 of the flexible body 12 will be located towards the widest portion of the ceiling fan blade. To secure the embodiment whereby the fastener 15 comprises an adjustable string, the user will move the slidable toggle towards the opening to prevent the ceiling fan blade cover 11 from detaching while the ceiling fan is operational. In some embodiment, the flexible body 12 will further include at least one decorative graphics or logos.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ceiling fan blade cover, comprising:

a flexible body;

the flexible body includes an open end and a closed end;

the open end and the closed end are on opposing ends of the flexible body;

a fastener encircles the open end;

the flexible body further comprises an internal volume;

an attaching member disposed on the flexible body;

whereby the attaching member is proximate to the closed end of the flexible body;

a lighting element is removably secured to the attaching member via a securing member, wherein the securing member is disposed on the lighting element; and whereby the securing member connects with the attaching member.

2. The ceiling fan blade cover of claim 1, wherein the fastener is an elastic band.

3. The ceiling fan blade cover of claim 1, wherein the fastener is an adjustable string.

4. The ceiling fan blade cover of claim 3, wherein the adjustable string further comprises a slidable toggle.

5. The ceiling fan blade cover of claim 1, wherein the attaching member and the securing member are a hook and loop fastener.

6. The ceiling fan blade cover of claim 1, wherein the lighting element further comprises a transceiver.

7. The ceiling fan blade cover of claim 6, wherein the transceiver is operably connected to a controller; whereby the controller comprises a plurality of actuators with functional capabilities for the lighting element.

8. The ceiling fan blade cover of claim 1, wherein the lighting element is a LED light.

9. The ceiling fan blade cover of claim 1, wherein the lighting element comprises a plurality of colored lights.

10. The ceiling fan blade cover of claim 1, wherein the flexible body further includes at least one decorative graphic or logo.

* * * * *